US010390640B2

(12) United States Patent
Turner et al.

(10) Patent No.: US 10,390,640 B2
(45) Date of Patent: Aug. 27, 2019

(54) DRINKING VESSEL PRODUCTS

(71) Applicant: LIQUOR APPEAL (PTY) LTD, Cape Town (ZA)

(72) Inventors: Rian Stewart Turner, Bergvliet (ZA); Dallas Lee Broughton, Kirstenhof (ZA)

(73) Assignee: Liquor Appeal (PTY) Ltd., Cape Town (ZA)

( * ) Notice: Subject to any disclaimer, the term of this patent is extended or adjusted under 35 U.S.C. 154(b) by 35 days.

(21) Appl. No.: 15/576,329

(22) PCT Filed: Aug. 14, 2015

(86) PCT No.: PCT/IB2015/056206
§ 371 (c)(1),
(2) Date: Nov. 22, 2017

(87) PCT Pub. No.: WO2017/029537
PCT Pub. Date: Feb. 23, 2017

(65) Prior Publication Data

US 2018/0160828 A1 Jun. 14, 2018

(51) Int. Cl.
*A47G 19/22* (2006.01)
*A47G 23/03* (2006.01)
(Continued)

(52) U.S. Cl.
CPC ..... *A47G 19/2255* (2013.01); *A47G 19/2205* (2013.01); *B65D 17/502* (2013.01);
(Continued)

(58) Field of Classification Search
CPC ..... A47G 19/12; A47G 19/22; A47G 19/23; A47G 19/2255; A47G 19/2205;
(Continued)

(56) References Cited

U.S. PATENT DOCUMENTS 648,435 A * 5/1900 Rider ..... B65D 1/06 215/377
782,710 A * 2/1905 Weller ..... A47G 19/2255 215/377
(Continued)

FOREIGN PATENT DOCUMENTS

| | | |
|---|---|---|
| DE | 3814937 C1 | 6/1989 |
| EP | 0309314 A1 | 3/1989 |
| WO | 2008020301 A1 | 2/2008 |

*Primary Examiner* — Gideon R Weinerth
(74) *Attorney, Agent, or Firm* — Laurence A. Greenberg; Werner H. Stemer; Ralph E. Locher

(57) ABSTRACT

A drinking vessel product includes a wine glass with an inner cavity filled at least partly with wine. The wine glass has a body that defines the cavity, an upper opening that is sealed with a removable seal such as a metal foil, and a smaller fill opening at the bottom. The glass includes a support that is attached to the body and that includes a pedestal, a stem and a stop formation that seals the fill opening. The body and support are molded from plastic materials. The cavity is filled with wine after the upper opening has been sealed, by inverting the glass and filling it from the fill opening, before fitting the support to seal the fill opening.

15 Claims, 4 Drawing Sheets

(51) Int. Cl.

| | |
|---|---|
| ***B65D 21/00*** | (2006.01) |
| ***B65D 21/02*** | (2006.01) |
| ***B65D 23/00*** | (2006.01) |
| ***B65D 85/72*** | (2006.01) |
| ***B65D 17/50*** | (2006.01) |
| *A47G 19/23* | (2006.01) |
| *A47G 19/12* | (2006.01) |
| *B67C 3/00* | (2006.01) |

(52) U.S. Cl.
CPC ..... *B65D 23/00* (2013.01); *B65D 85/72* (2013.01); *A47G 19/12* (2013.01); *A47G 19/22* (2013.01); *A47G 19/23* (2013.01); *B65D 17/501* (2013.01); *B65D 23/001* (2013.01); *B65D 2517/5013* (2013.01); *B67C 3/00* (2013.01)

(58) Field of Classification Search
CPC .. B65B 3/00; B01F 13/003; B01F 2215/0072; B65D 17/501; B65D 17/502; B65D 23/00; B65D 23/001; B65D 85/72; B65D 2517/5013; B65D 1/06; B67C 3/00; B67C 2007/006
USPC ..... 220/630, 203.13; 215/223, 10, 377; 53/403, 473; 222/481
See application file for complete search history.

(56) References Cited

U.S. PATENT DOCUMENTS 2,158,230 A * 5/1939 Godfrey ..... A47G 19/2205 215/372
2,543,163 A * 2/1951 Greiner ..... B65D 1/06 220/203.13
2,918,188 A * 12/1959 Todd ..... A47G 19/2255 215/377
3,369,687 A * 2/1968 Walls ..... B65D 21/0217 206/508
3,482,731 A * 12/1969 Douty ..... B65D 7/04 215/377
3,526,335 A * 9/1970 Swett ..... A47G 19/2255 220/630
5,402,907 A 4/1995 Liu
5,586,647 A * 12/1996 Barta ..... A47G 19/2255 206/217
8,763,828 B2 * 7/2014 Dunn ..... A61J 9/04 215/11.5
2002/0104819 A1 * 8/2002 Matsui ..... B29C 49/20 215/377
2003/0098311 A1 * 5/2003 Parentini ..... A47G 19/2255 220/630
2005/0139570 A1 * 6/2005 Lambert ..... A47G 19/2205 215/223
2008/0099364 A1 * 5/2008 Niedzwiecki ..... A47G 19/2255 206/517
2008/0223478 A1 * 9/2008 Hantsoo ..... B65D 1/265 141/2
2008/0314933 A1 * 12/2008 Leonoff ..... B65D 23/00 222/215
2011/0174763 A1 * 7/2011 Kennedy ..... A47G 19/2255 215/377
2012/0273373 A1 * 11/2012 Wu ..... A47G 19/2205 206/217
2013/0140721 A1 * 6/2013 Borden ..... B01F 5/0428 261/76
2013/0228544 A1 * 9/2013 Benetti ..... A47G 19/2255 215/378
2014/0054304 A1 * 2/2014 Hu ..... A47G 19/2255 220/630
2014/0291335 A1 * 10/2014 Lee ..... A45F 3/20 220/630
2016/0353909 A1 * 12/2016 Fishbone ..... A47G 19/2205
2017/0001853 A1 * 1/2017 Park ..... B67D 1/1272
2017/0347819 A1 * 12/2017 Weiss ..... A47G 19/2255
2018/0229904 A1 * 8/2018 Zanatta ..... A47G 19/2255

* cited by examiner

DRINKING VESSEL PRODUCTS

FIELD OF THE INVENTION

This invention relates to drinking vessels that are used as sealed containers for beverages, prior to consuming the beverages. The drinking vessels are particularly suitable for beverages such as wine that are prone to oxidation when exposed to ambient oxygen, although the use of the drinking vessels is not restricted to any type of beverage.

BACKGROUND TO THE INVENTION

It is often convenient for beverages to be sold in containers containing single servings of the beverages, where the containers also serve as the vessels from which the beverages are consumed. These vessels (e.g. metal cans or glass bottles) have become popular for many beverages such as soft drinks and beer, but there is some resistance to their use for wines.

The consumption of wine is generally enhanced if the vessel from which it is consumed is shaped so that the wine has a large upper surface and has a large opening—both of which enhance the consumer's olfactory experience. Further, the vessel should preferably have a stable pedestal—preferably with a stem, by which the vessel can be held and which can assists in limiting heat transfer from the consumer's hand to the wine. These features are all embodied in conventional wine glasses and in addition to the practical features of wine glasses, consumers often frown upon the use of other vessels for drinking wine.

In order to store wine for extended periods, its exposure to oxygen should be kept to a minimum. This can be achieved in sealed glass bottles—especially if the necks of the bottles were purged with nitrogen during the filling process, but bottles are not suitable for direct consumption of wine—for reasons provided above.

Attempts have been made to provide single serving containers in which wine is sold and which can be used for drinking the wine. These containers typically resemble a flat-bottomed drinking cup, of transparent thermoplastic material, with a removable foil seal extending over its opening. The containers are shaped for cost-effective injection moulding, with the result that they resemble drinking cups suitable for soft drinks, without the stem and base that are preferred for drinking wine. Further, the shelf life of wine in these containers is often short, partly because of oxygen ingress by osmosis through the thermoplastic container walls and partly because of ineffective nitrogen purging when the containers are filled. The large openings of the containers allow nitrogen to escape and/or allow excessive ambient oxygen ingress into the containers, before they are sealed.

The present invention seeks to provide drinking vessels that serve as containers for beverages and also serve as the vessels from which the beverages are consumed, which address the shortfalls of existing containers/vessels mentioned above. In particular, the invention seeks to provide drinking vessels that enhance shelf life for the beverages and that appeal to consumers. In addition, the drinking vessels should preferably be cost-effective and be light in weight, yet robust enough for use out-doors. The invention seeks to provide drinking vessels particularly suitable for wine, but its use also extends to other beverages.

SUMMARY OF THE INVENTION

According to one aspect of the present invention there is provided a drinking vessel product comprising:

a body defining an inner cavity, a fill opening and a consumption opening, the fill opening and consumption opening each being in communication with the inner cavity and the fill opening being substantially smaller than the consumption opening;

a removable seal extending across the consumption opening in a sealing manner; and a beverage inside the inner cavity;

said drinking vessel product further having a stop formation sealing the fill opening.

The drinking vessel product may include a support formation that is integrally formed with the body and the support formation may define a fill passage that is in communication with the fill opening and the stop formation may be receivable inside the fill passage. In particular, the support formation may define a pedestal and a hollow stem and the fill passage may be defined along the hollow inside of the stem.

The drinking vessel product may include a support formation that is attachable to the body, e.g. in clipping fashion, and the stop formation may be connected to support formation. The support formation may define a pedestal and a stem and the stem may be hollow.

The stop formation may include a plug, seal, O-ring, or any means for sealing the fill opening.

The body may define a side wall and the side wall may include an embedded film, such as in-mould decoration, which may be of a material that reduces oxygen permeability of the side wall.

The body may define a side wall and bottom wall and the support formation may butt against the body in the vicinity of a lower edge of the side wall, preferably so that outer surfaces of the side wall and support formation extend continuously.

The side wall may have a substantially straight profile, in side view, e.g. the side wall may be substantially cylindrical or may be frusto-conical.

The fill opening may be on an opposite side of the inner cavity than the consumption opening—which practically means that the fill opening is at the bottom of the cavity, in use.

According to another aspect of the present invention, there is provided a method of providing a drinking vessel product, said method comprising:

sealing a consumption opening of a drinking vessel with a removable seal;

orientating the drinking vessel so that a fill opening is generally at the top of an inner cavity of the drinking vessel;

filling the inner cavity at least in part with a beverage, though the fill opening; and sealing the fill opening with a stop formation.

The method may include purging the inner cavity with an inert gas through the fill opening, prior to sealing the fill opening.

The method may include attaching a support formation to the drinking vessel, e.g. with clips and the stop support formation may be connected to the support formation, so that the fill opening is sealed by the stop formation when the support formation is attached to the drinking vessel.

BRIEF DESCRIPTION OF THE DRAWINGS

For a better understanding of the present invention, and to show how it may be carried into effect, the invention will now be described by way of non-limiting example, with reference to the accompanying drawings in which.

DETAILED DESCRIPTION OF THE DRAWINGS

Figure 1:
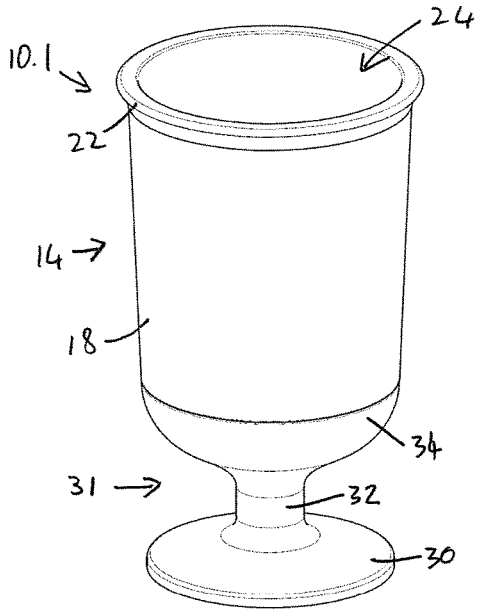
FIG. 1 shows a three-dimensional view of a first embodiment of a drinking vessel according to the present invention.
Figure 2:
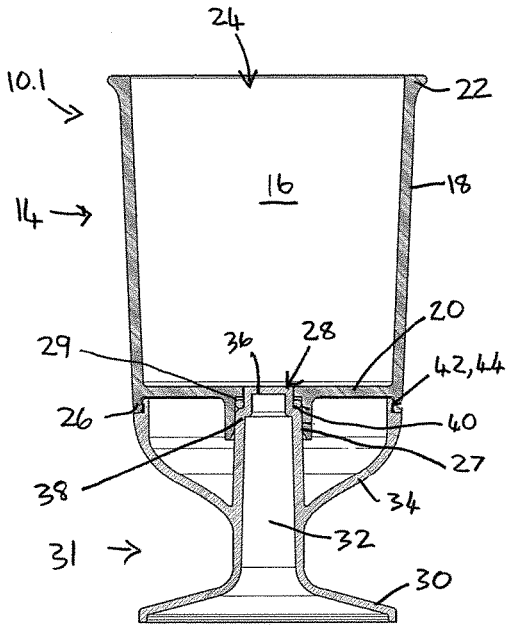
FIG. 2 shows a sectional side view of the drinking vessel of FIG. 1.
Figure 3:
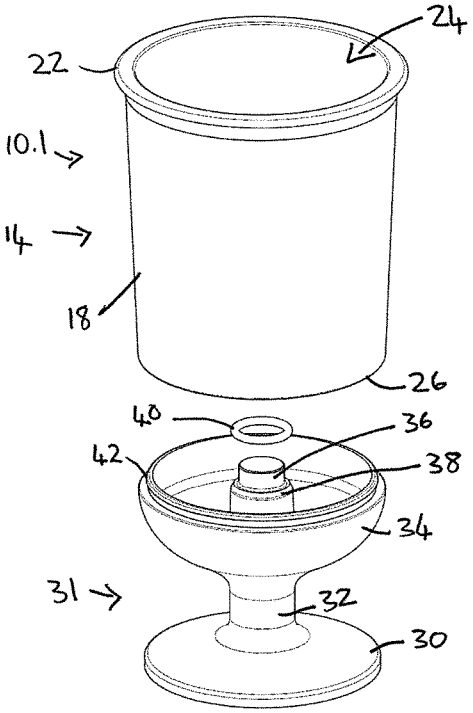
FIG. 3 shows a first exploded view of a body, O-ring and support formation of the drinking vessel of FIG. 1.
Figure 4:
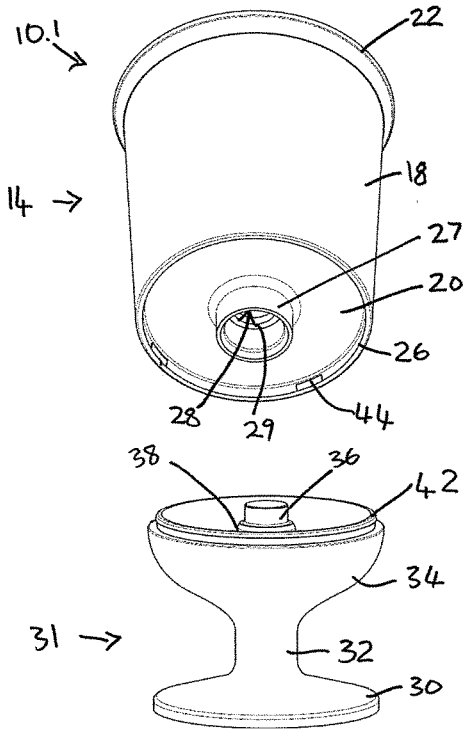
FIG. 4 shows a second exploded view of the body and support formation of the drinking vessel of FIG. 1.

Referring to the drawings, a drinking vessel according to the present invention is generally identified by reference number 10 and a drinking vessel product (comprising a drinking vessel containing a beverage) is generally identified by reference number 12. Different embodiments of the invention are identified by suffixes to the reference numbers and features that are common between different embodiments of the invention, are identified by the same reference numbers.

Referring to FIGS. 1 to 4, a first embodiment of a drinking vessel 10.1 includes a body 14 that defines an inner cavity 16, a side wall 18 and a disc-shaped bottom wall 20. The side wall 18 is almost cylindrical, although it tapers outwards towards its upper edge, where it forms a lip 22 around the circumference of a consumption opening or upper opening 24. The side wall 18 has a straight profile in side view, with a small ridge 26 extending downwards from the lower circumferential edge of the side wall, where it is integrally formed with the bottom wall 20.

The bottom wall 20 defines a fill opening 28 in its centre—which is substantially smaller than the upper opening 24 and a cylindrical neck 27 extends below the bottom wall, around the fill opening, with a small shoulder 29 along the circumference of the fill opening.

The body 14 is a unitary article that is preferably injection moulded from a suitable thermoplastic material such as PET.

A support formation 31 is provided, which includes a pedestal 30, a hollow stem 32 and a skirt 34 that is joined to the stem, but extends outwards and upwards from its attachment to the stem. At the upper end of the stem 32, the support formation 31 forms a stop formation 36 that is received tightly inside the fill opening 28, with an upper surface of the stop formation flush with the upper surface of the bottom wall 20, to seal the fill opening. A circumferential shoulder 38 extends around the stop formation 36 and an O-ring 40 is receivable around the stop formation, above the shoulder. When the support formation 31 is attached to the body 14, the O-ring 40 fits in a sealing manner between the shoulders 29 and 38 and the upper circumferential surface of the stem 32, immediately below the shoulder 38, is tightly received inside the neck 27—preferably with a taper lock.

The upper edge of the skirt 34 has the same general diameter as the ridge 26 at the bottom of the outer wall 18 and the skirt includes a circumferential undercut with a clipping ridge 42 that is attachable to clips 44 formed inside the ridge 26. When the support formation 31 is attached to the body 14 with the stop formation 36 sealing the fill opening 28, as described above, the upper edge of the skirt 34 butts against the lower edge of the ridge 26 and they are attached together by clipping action between the clipping ridge 42 and clips 44. When so attached, the outer surfaces of the side wall 18 and the skirt 34 extend continuously, so that the outer profile of the vessel 10 resembles the continuous shape of a conventional drinking vessel for wine, made from glass or clay.

Like the body 14, the support formation 31 is a unitary article, preferably injection moulded from a thermoplastic polymer.

Figure 5:
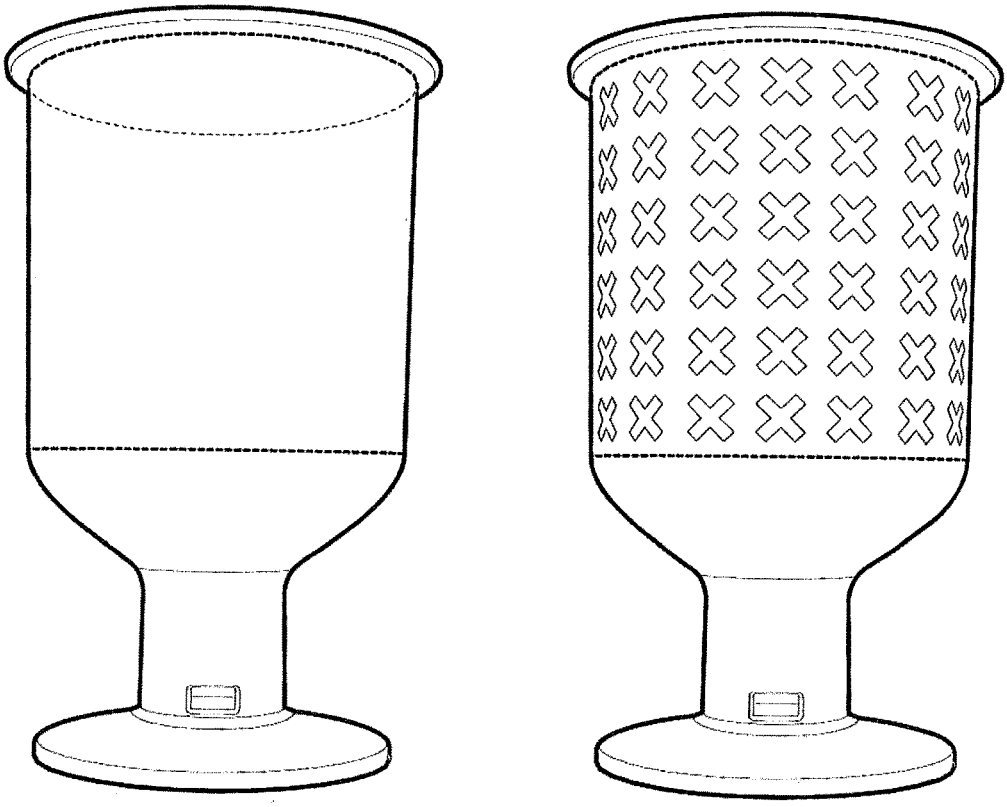
FIG. 5 shows pictorial views of two of the drinking vessels of FIG. 1, one without and one with an in-mould liner.

Referring also to FIG. 5, the body 14 may be made of a single material, such as the drinking vessel shown on the left in FIG. 5, but in a preferred embodiment, the side wall 18 includes an embedded film in the form of in-mould decoration or an in-mould label, that is embedded during the injection moulding process and that can extend almost the entire height of the side wall, from the bottom of the skirt 34 to a height just short of the lip 22. The embedded film is preferably made of a material that is different from the side wall and that reduces oxygen permeability of the side wall 18. The straight profile of the side wall 18, with clearly defined upper and lower edges (at the lip 22 and ridge 26) allow easy placement of the embedded film during the injection moulding process.

Figure 6:
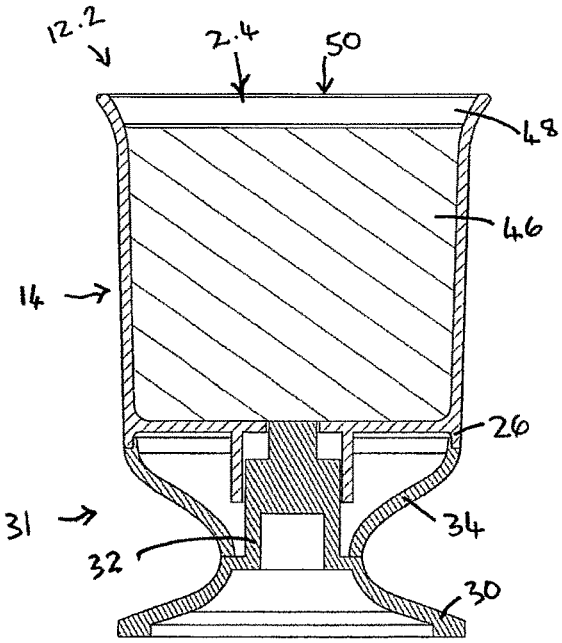
FIG. 6 shows a sectional side view of a drinking vessel product comprising a second embodiment of a drinking vessel according to the present invention, containing a beverage.

Referring to FIG. 6, the drinking vessel product 12.2 includes a body 14 much as that shown in FIGS. 1 to 5, with a beverage such as wine 46 inside the inner cavity 16 (with a small gap 48 above the wine) and with a removable seal 50, preferably of a metal foil, extending across the upper opening 24.

The support formation 31 is similar to the support formation shown in FIGS. 1 to 5, except that the skirt 34 is a separate component from the rest of the support formation and extends from the pedestal 30 to the ridge 26, around the outside of the stem 32, without exposing the stem.

Figure 7:
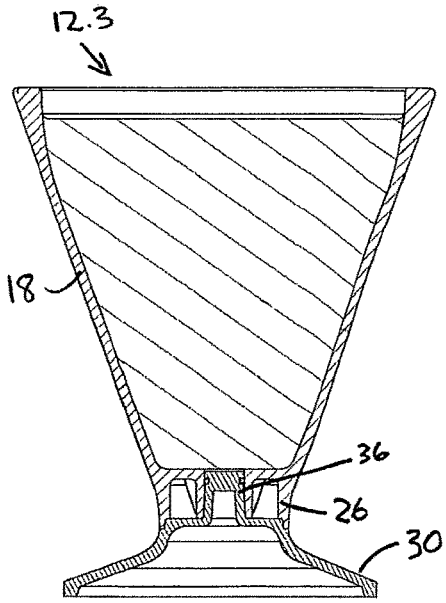
FIG. 7 shows a sectional side view of a drinking vessel product comprising a third embodiment of a drinking vessel according to the present invention, containing a beverage.

Referring to FIG. 7, the drinking vessel product 12.3 differs from those shown in FIGS. 1 to 6 in that the side wall 18 has a more pronounced tapering profile and the support formation 31 does not include a skirt, but instead, the lower edge of the ridge 26 attaches directly to the pedestal 30 and the stop formation 36 extends directly from the pedestal, without a stem.

Figure 8:
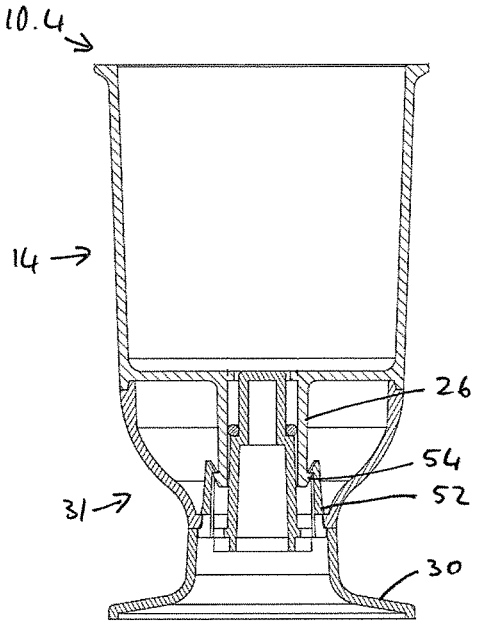
FIG. 8 shows a sectional side view of a forth embodiment of a drinking vessel according to the present invention.

Referring to FIG. 8, the drinking vessel 10.4 differs from that shown in FIGS. 1 to 5 in that the skirt 34 is a separate component from the rest of the support formation 31 (as in FIG. 6). Further, the pedestal 30 is attached to the body 14 with clips 52 of the support formation 31 that clip onto a clipping ridge 54 at the bottom of the ridge 26.

Figure 9:
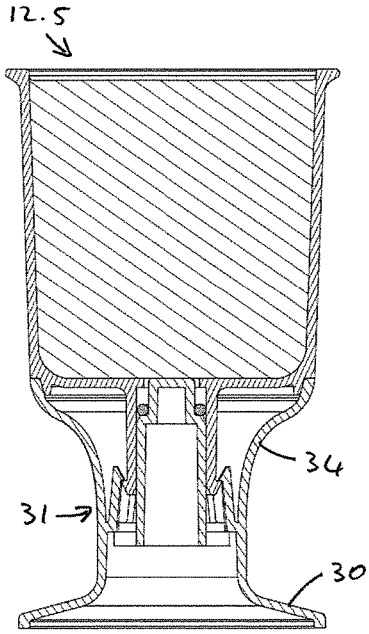
FIG. 9 shows a sectional side view of a drinking vessel product comprising a fifth embodiment of a drinking vessel according to the present invention, containing a beverage.
Figure 10:
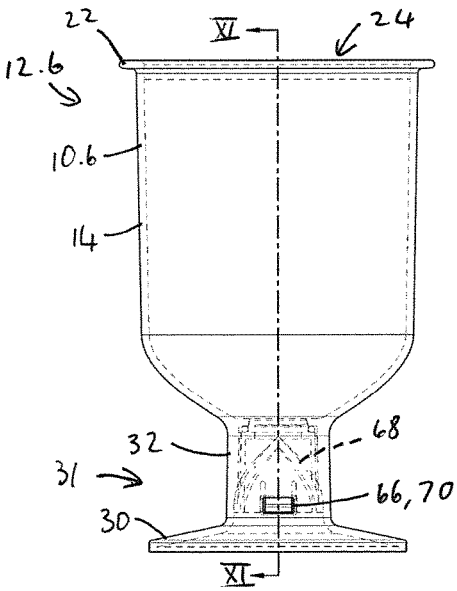
FIG. 10 shows a side view of a sixth embodiment of a drinking vessel product according to the present invention.
Figure 11:
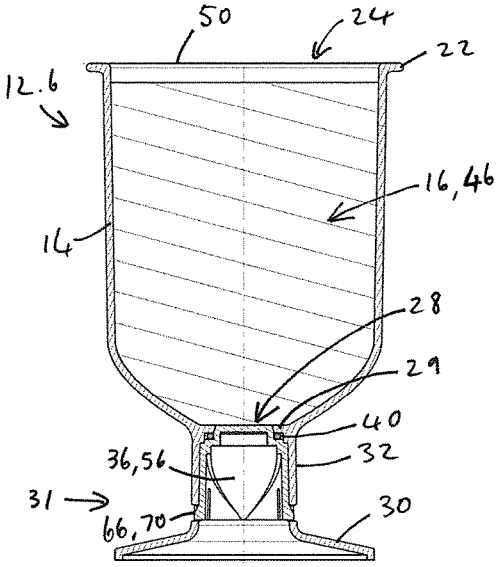
FIG. 11 shows a sectional side view of the drinking vessel product of FIG. 10, taken at XI-XI.
Figure 12:
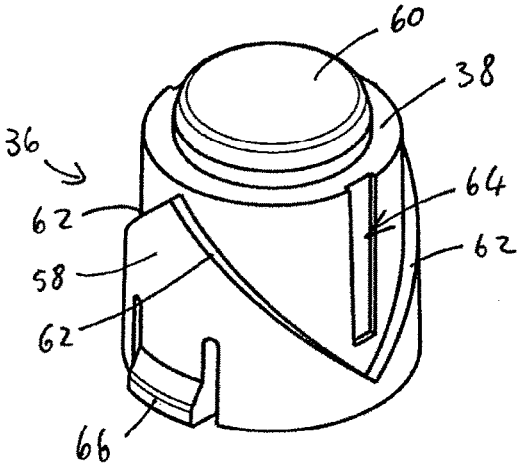
FIG. 12 shows a top three-dimensional view of a stop formation of the drinking vessel product of FIG. 10.
Figure 13:
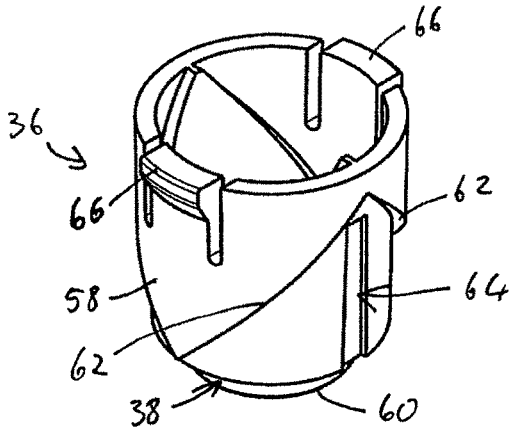
FIG. 13 shows a bottom three-dimensional view of the stoop formation of FIG. 12.
Figure 14:
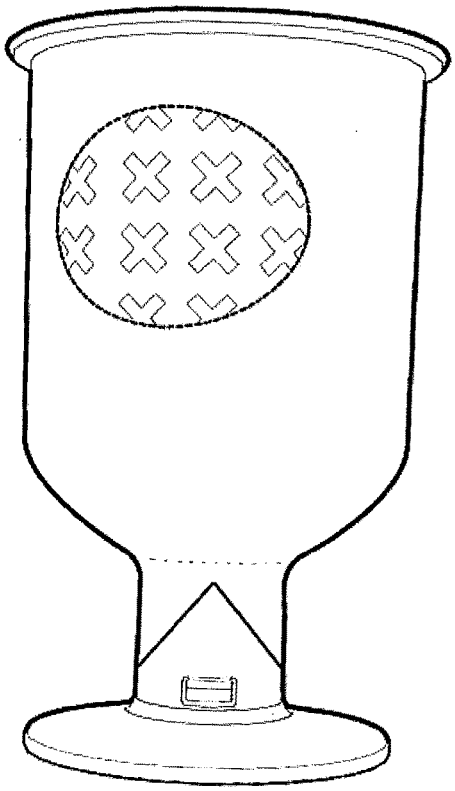
FIG. 14 shows a pictorial view of the drinking vessel product of FIG. 10.

Referring to FIG. 9, the drinking vessel product 12.5 differs from the drinking vessel shown in FIG. 8 in that the skirt 34 is integrally formed with the rest of the support formation 31.

Referring to all the drawings, to provide a drinking vessel product 12, the removable seal 50 is applied to the lip 22 to seal the upper opening 24 and the body 14 is inverted so that the fill opening 28 faces upwards (i.e. the fill opening is at the top of the inner cavity 16). Wine or another beverage is poured into the inner cavity 16 via the fill opening 28 and the remainder of the inner cavity is purged by injecting an inert gas such as nitrogen via the fill opening. The fill opening 28 is sealed by pressing the support formation 31 onto the inverted body 14, so that the stop formation 36 seals the fill opening, with additional sealing provided by the O-ring 40 and the taper lock between the ridge 26 and the outer circumference of the stem 32. At the same time as sealing the fill opening 28, the support formation 31 is also attached to the body 14 by engagement of the clips and ridges, 44,42 or 52,54. The drinking vessel product 12 is now complete and can be righted to its normal upright orientation.

The embodiments shown in the drawings only serve as non-limiting examples of how the invention can be put to effect and the invention is not necessarily limited to details of these examples. Without detracting from this general principle, it should be emphasized that sealing of the fill opening 28 can include many techniques instead of those described above, or in addition to them, e.g. using a metal foil seal, cork, cap, or the like.

The described invention holds many advantages, which include providing drinking vessels 10 that are suitable for containing wine 46 (or other beverages) with a long shelf life and that are suitable for consumption of the wine directly from the drinking vessels. At the same time, the drinking vessels 10 are inexpensive, light, and durable and are attractive to consumers because they fulfil the shape requirements of vessels for drinking wine and they are attractive in the sense that they resemble conventional drinking vessels for wine and/or other beverages.

The long shelf life of the wine 46 is extended in particular by the use of in-mould labels that are embedded in the side walls 18 and by the substantially improved effectiveness of inert gas purging through the narrow fill opening 28, rather than the much larger upper opening 24.

Referring to FIGS. 10-14, a sixth embodiment of the drinking vessel product 12.6 includes a unitary body 14 of a suitable thermoplastic material such as PET, that defines an inner cavity 16, a side wall 18 that tapers to its bottom, where the body forms a hollow stem 32, which extends down to a pedestal 30. Like other embodiments, the body 14 forms a lip 22 around the circumference of an upper opening 24 that is sealed with a removable seal 50 and the cavity 16 is filled with wine 46.

The body 14 does not define a bottom wall, but defines a fill opening 28, centrally at the bottom of the cavity 16, with a small shoulder 29 along the circumference of the fill opening.

The stem 32 and pedestal 30 together form a support formation 31 that is integrally formed with the body 14 and the hollow inside of the stem forms a generally cylindrical fill passage 56 that is in communication with the fill opening 28 and is open at its bottom (centrally in the pedestal 30).

The stop formation 36 is in the form of a generally cylindrical plug with a cylindrical wall 58 that is integrally formed with a disc 60 at its top, with a shoulder 38 extending around upper edges of the stop formation, where the cylindrical wall meets up with the disc. On the outside of the cylindrical wall 58, four angled guide formations 62 are defined and two vent grooves 64 extend on opposite sides of the stop formation 36. Each of the guide formations 62 is in the form of an angled step and the four guide formations are oriented in two V-formations on opposing sides of the stop formation 36, with the vent grooves defined in each of the V-formations. Two clips 66 are provided in opposite positions at the lower circumferential edge of the cylindrical wall 58.

The inside of the fill passage 56 has a shape that is complemental to the cylindrical wall 58 of the plug, with complemental angled guide formations 68 and with opposing clip apertures 70 in which the clips 66 are receivable, but without formations that are complemental to the vent grooves 64.

To fill the cavity 16 with wine 46, the drinking vessel 10.6 is inverted, with the seal 50 in place and without the stop formation 36. The cavity 16 is filled via the fill passage 56 and fill opening 28 and any remaining space in the cavity 16 and the fill passage 56 is purged with an inert gas.

An O-ring 40 is placed on the shoulder 29 in the fill passage 56 (or on the shoulder 38) and the stop formation 36 is inverted and pressed into the fill passage. While the stop formation 36 travels longitudinally along the fill passage 56, it is vented with gas escaping along the vent grooves 64 and the angled guide formations 62,68 of the stop formation and fill passage interact to guide the stop formation, rotating it in helical fashion, if necessary, to ensure that the clips 66 and clip apertures 70 are aligned.

Once the stop formation 36 has been fully inserted in the fill passage 56, the O-ring 40 is pinched in a sealing manner between the shoulders 29,38 and the disc 60 seals the fill opening 28 in a manner that is flush along the inside of the cavity 16, while the clips 66 grip the clip apertures 70 to hold the stop formation in place. The drinking vessel product 12.6 is righted and is ready for use.

The invention claimed is:

1. A drinking vessel, comprising:

a body defining an inner cavity, a consumption opening that is in communication with the inner cavity, and a fill opening and fill passage that are in communication with the inner cavity, said fill opening being substantially smaller than the consumption opening and being on an opposite side of the inner cavity, from the consumption opening;

a removable seal extending across the consumption opening in a sealing manner; and a stop formation that is insert able into the fill passage to seal the fill opening;

wherein at least one clip is defined on the stop formation and at least one vent groove is defined between the stop formation and the fill passage, the stop formation being configured to travel along the fill passage while gas is vented along the vent groove, and said clip holding the stop formation in place when the stop formation has been fully inserted in the fill passage, to seal the fill opening.

2. The drinking vessel according to claim 1, which includes at least one guide formation defined on at least one of the stop formation and the fill passage.

3. The drinking vessel according to claim 2, wherein said at least one guide formation includes angled steps.

4. The drinking vessel according to claim 3, wherein said at least one guide formation is oriented in V-formation.

5. The drinking vessel according to claim 2, wherein said at least one guide formation is oriented in V-formation.

6. The drinking vessel according to claim 1, wherein said cavity is at least partly filled with wine.

7. The drinking vessel according to claim 1, wherein said drinking vessel includes a support formation that is integrally formed with the body.

8. The drinking vessel according to claim 7, wherein the support formation defines the fill passage.

9. The drinking vessel according to claim 8, wherein the support formation defines a pedestal and a hollow stem, said fill passage being defined along the hollow inside of the stem.

10. The drinking vessel according to claim 1, wherein the body defines a side wall and said side wall includes an embedded film.

11. The drinking vessel according to claim 10, wherein the embedded film is of a material that reduces oxygen permeability of the side wall.

12. A method of using the drinking vessel of claim 1, the method comprising:

sealing a consumption opening of a drinking vessel with a removable seal;

inverting the drinking vessel so that a fill opening and a fill passage of the drinking vessel are generally at a top of an inner cavity of the drinking vessel;

filling the inner cavity of the drinking vessel at least partly with a beverage, through the fill passage and fill opening;

inserting a stop formation into the fill passage, and venting gas along at least one vent groove defined between the fill passage and the stop formation, while inserting the stop formation into the fill passage;

sealing the fill opening with the stop formation when the stop formation is fully inserted into the fill passage; and holding the stop formation in place.

13. The method according to claim 12, which includes purging the inner cavity with an inert gas through the fill opening, prior to inserting the stop formation into the fill passage.

14. The method according to claim 13, which includes guiding the stop formation to align a clip, while the stop formation is inserted into the fill passage.

15. The method according to claim 14, which includes rotating the stop formation helically while being inserted into the fill passage.

* * * * *